US005767770A

United States Patent [19]

Gadonniex

[11] Patent Number: 5,767,770

[45] Date of Patent: Jun. 16, 1998

[54] SEMI-HARD MAGNETIC ELEMENTS FORMED BY ANNEALING AND CONTROLLED OXIDATION OF SOFT MAGNETIC MATERIAL

[75] Inventor: Dennis Michael Gadonniex, Delray Beach, Fla.

[73] Assignee: Sensormatic Electronics Corporation, Boca Raton, Fla.

[21] Appl. No.: 673,928

[22] Filed: Jul. 1, 1996

[51] Int. Cl.[6] ..... G08B 13/187; H01F 1/153

[52] U.S. Cl. ..... 340/551; 148/561; 420/125; 420/590; 340/572

[58] Field of Search ..... 340/551, 572; 148/561, DIG. 3, DIG. 22, DIG. 71; 420/125, 590

[56] References Cited

U.S. PATENT DOCUMENTS

| | | | |
|---|---|---|---|
| 4,510,489 | 4/1985 | Anderson, III et al. | 340/572 |
| 4,510,490 | 4/1985 | Anderson, III et al. | 340/572 |
| 5,252,144 | 10/1993 | Martis | 148/121 |
| 5,351,033 | 9/1994 | Liu et al. | 340/572 |

*Primary Examiner*—Glen Swann

*Attorney, Agent, or Firm*—Robin, Blecker, Daley and Driscoll

[57] ABSTRACT

A semi-hard magnetic element is formed by at least partially crystallizing an amorphous soft iron-metalloid material. The heating process used to achieve crystallization includes a controlled oxidation stage to increase the level of remanent flux that is provided when the processed magnetic element is placed in a fully magnetized state.

15 Claims, 4 Drawing Sheets

SEMI-HARD MAGNETIC ELEMENTS FORMED BY ANNEALING AND CONTROLLED OXIDATION OF SOFT MAGNETIC MATERIAL

BACKGROUND OF THE INVENTION

This invention relates to magnetic elements and, in particular, to semi-hard magnetic elements and methods of making same.

As used herein, the term semi-hard magnetic element means a magnetic element having semi-hard magnetic properties which are defined herein as a coercivity in the range of about 10–500 Oersted (Oe) and a remanence, after removal of a DC magnetization field which magnetizes the element substantially to saturation, of about 6 kilogauss (kG) or higher. Semi-hard magnetic elements having these semi-hard magnetic properties have been used in a number of applications. In one particular application, the elements serve as control elements for markers in a magnetic electronic article surveillance (EAS) system. A magnetic marker of this type is disclosed, for example, in U.S. Pat. No. 4,510,489.

In the marker of the '489 patent, a semi-hard magnetic element is placed adjacent to a magnetostrictive amorphous element. By magnetizing the semi-hard magnetic element substantially to saturation, the resultant remanence magnetic induction of the magnetic element arms or activates the magnetostrictive element so that it can magnetically resonant or vibrate at a predetermined frequency in response to an interrogating magnetic field.

This mechanical vibration results in the magnetostrictive element generating a magnetic field at the predetermined frequency. The generated field can then be sensed to detect the presence of the marker. By demagnetizing the semi-hard magnetic element, the magnetostrictive element is disarmed or deactivated so that it can no longer mechanically resonate at the predetermined frequency in response to the applied field. This type of marker is sometimes referred to as a "magnetomechanical" marker, and the corresponding EAS system is referred to as a magnetomechanical EAS system.

A technique for producing low-cost semi-hard magnetic elements usable as control elements in magnetomechanical markers was disclosed in U.S. Pat. No. 5,351,033, which is commonly assigned with the present application. According to the disclosure of the '033 patent, amorphous metalloid materials, such as Metglas® 2605TCA and 2605S2, which have soft magnetic properties as cast, are processed so that the materials develop semi-hard magnetic properties. The process disclosed in the '033 patent includes cutting the as-cast amorphous alloy ribbons into discrete strips and then annealing the strips so that at least a part of the bulk of the strips is crystallized.

It is desirable to reduce the "footprint" of magnetomechanical markers and otherwise to reduce the size of magnetomechanical markers, and for that purpose it would be desirable to provide semi-hard control elements that can both be produced at low cost and provide a larger magnetic flux per given volume of material than known control elements.

OBJECTS AND SUMMARY OF THE INVENTION

It is an object of the invention to process a magnetic material so as to increase the magnetic flux provided when the material is magnetized.

It is another object of the invention to provide low-cost control elements for magnetomechanical EAS markers.

It is a further object of the invention to provide a magnetomechanical marker that is narrow in profile in the primary plane of the marker.

In accordance with the principles of the present invention, the above and other objectives are realized by a method of making a magnetic element including the steps of providing a magnetic element formed of a magnetically soft metallic material, heating the material to a temperature that is above a crystallization temperature for the material, the heating being performed in a substantially inert atmosphere, exposing the heated material to oxygen while maintaining the material at a temperature above the crystallization temperature, ending the exposing step by restoring the substantially inert atmosphere, and cooling the material to room temperature in the restored inert atmosphere. Preferably, the metallic material is annealed in the inert atmosphere for respective periods of at least one hour both before and after the step of exposing the heated material to oxygen. The inert atmosphere may be formed of substantially pure nitrogen gas, and the step of exposing the material to oxygen may include exposing the material to ambient air which is permitted to enter the heating chamber. A preferred material for application of this process is an amorphous metalloid designated as Metglas® 2605SB1, composed essentially of iron, silicon and boron.

The controlled oxidation of the material provided by the above-described process causes the resulting semi-hard magnetic element to provide a magnetic flux greater than could be produced by using either uncontrolled oxidation, or by processing the material entirely in an inert atmosphere. Consequently, the process of the present invention makes it possible to produce a small-sized and low cost control element for a magnetomechanical marker.

BRIEF DESCRIPTION OF THE DRAWINGS

The above and other features, aspects and advantages of the present invention will become more apparent upon reading the following detailed description in conjunction with the accompanying drawings, in which.

DETAILED DESCRIPTION

Figure 1:
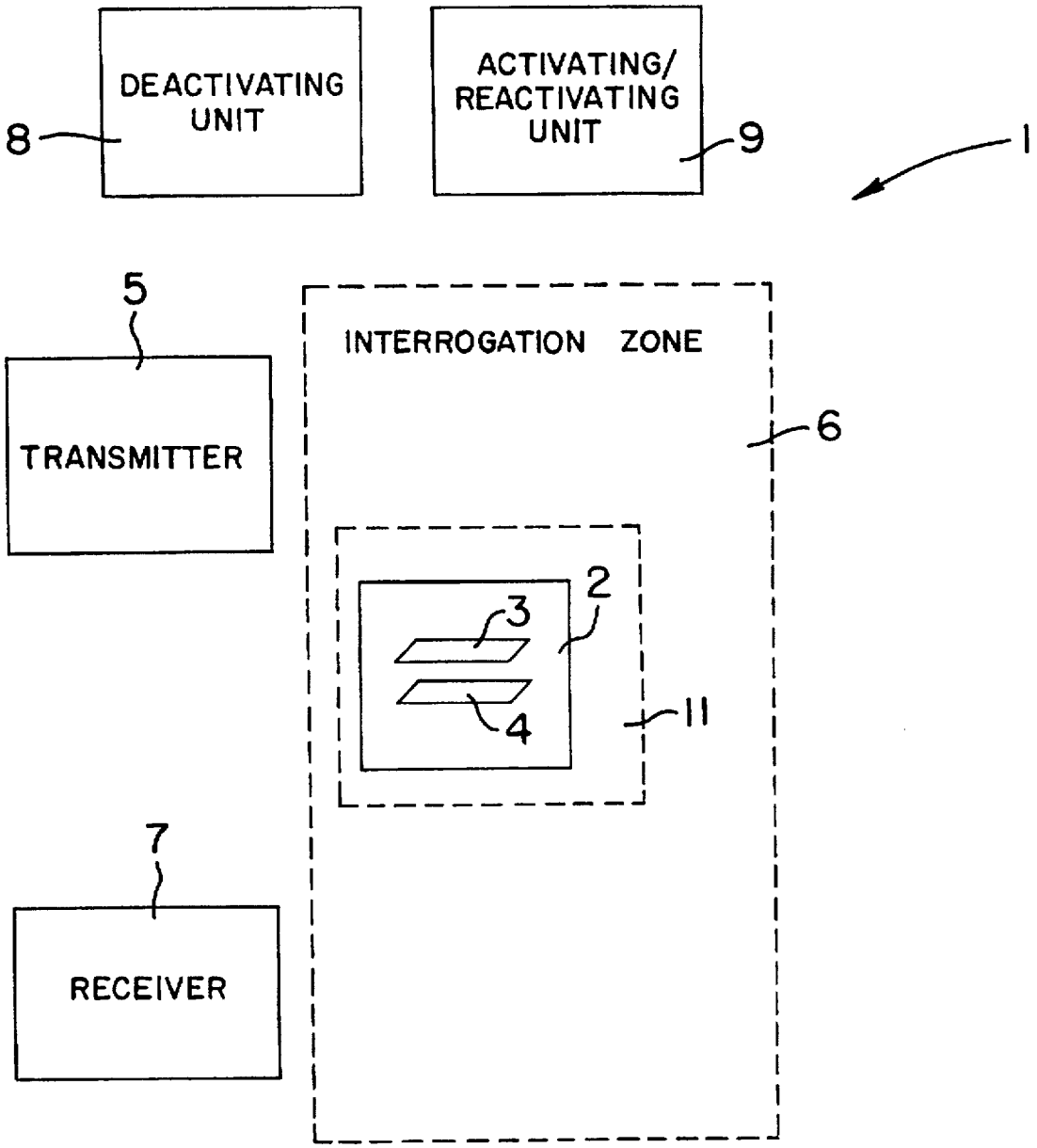
FIG. 1 shows an EAS system using a magnetic marker including a semi-hard magnetic element produced in accordance with the principles of the present invention.

FIG. 1 illustrates a magnetomechanical EAS system 1 in which the presence of an article 11 in an interrogation zone 6 is detected by sensing a marker 2 attached to the article. The marker 2 includes a semi-hard magnetic element 3 designed in accordance with the principles of the present invention. The semi-hard magnetic element 3 is used to activate and deactivate an adjacent signal generating element 4 of the marker 2. The signal generating element 4 can be an amorphous magnetostrictive element as described in the aforementioned '489 patent or as described in U.S. Pat. No. 5,568,125, issued Oct. 22, 1996.

The EAS system 1 further includes a transmitter 5 which transmits an AC magnetic field into the interrogation zone 6. The presence of the marker 2 and, thus, the article 11 in the interrogation zone 6 is detected by a receiver 7 which detects a signal generated by the interaction of the signal generating element 4 of the marker 2 with the transmitted magnetic field.

By placing the semi-hard element 3 in a first magnetic state (magnetized), the signal generating element 4 of the marker can be enabled and placed in an activated state so that it interacts with the applied field to generate a signal. Then, by changing the magnetized state of the element 3 (from magnetized to demagnetized), the signal generating element 4 is disabled and placed in a deactivated state so that it no longer interacts with the field to generate a signal. In this way, the marker 2 can be activated, deactivated and reactivated as desired in a deactivating unit 8 and an activating/reactivating unit 9.

EXAMPLE

An illustrative example of the principles of the present invention will now be described. The material processed in this example is commercially available from AlliedSignal Corp. under the designation 2605SB1. This material is believed to be composed exclusively of iron, silicon and boron. The material is obtained from AlliedSignal in the form of a long thin amorphous metalloid ribbon, wound on a reel, and having a width of about 6 millimeters and a thickness of about 50.8 microns (2 mils).

Figure 2:
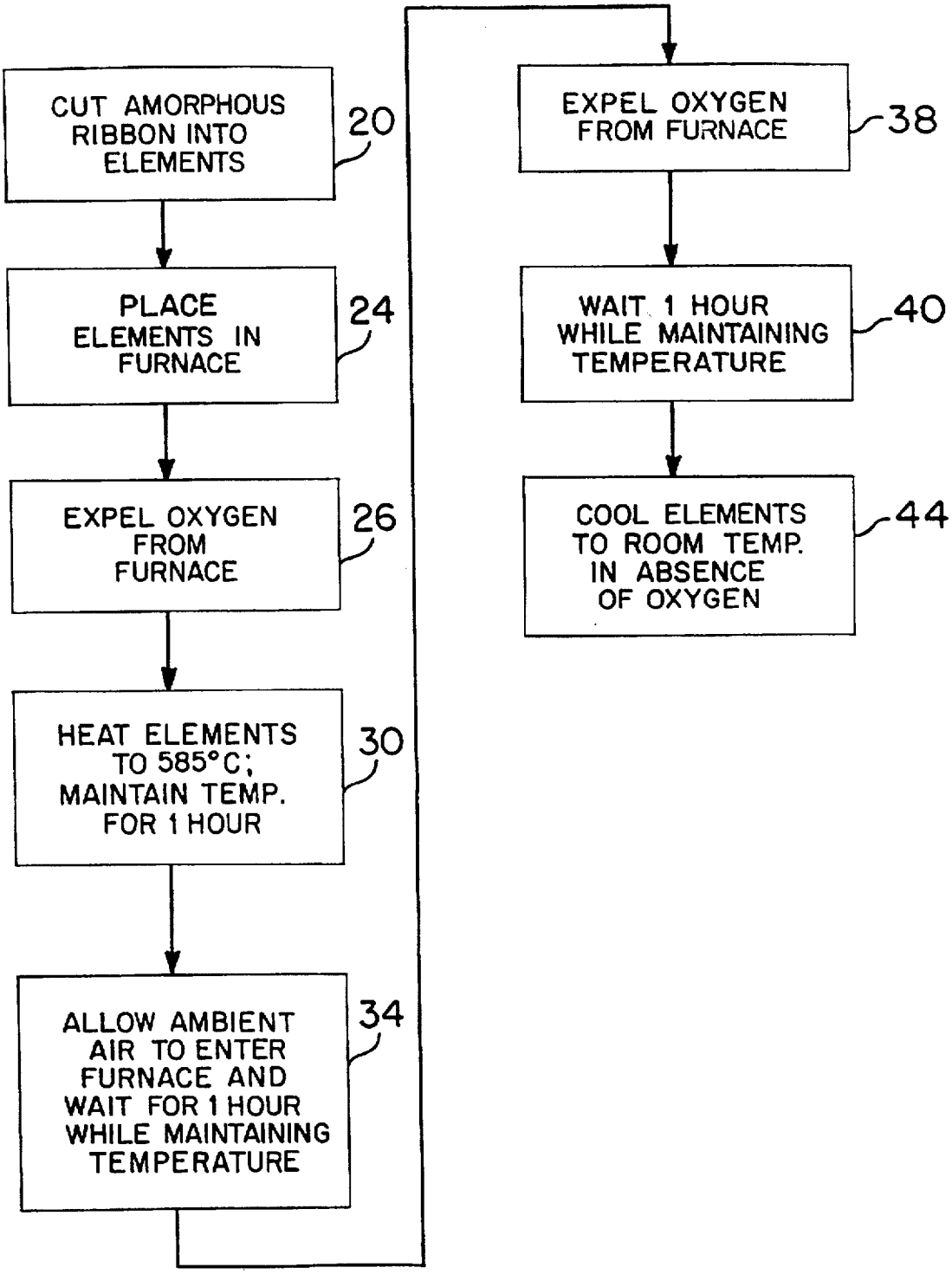
FIG. 2 shows a flow diagram of the processing steps applied to an amorphous metalloid material to form the semi-hard magnetic element of the invention.

The processing steps performed in accordance with this example are illustrated in FIG. 2, and include an initial step 20, in which the continuous ribbon of as-cast material is cut into discrete strips. Each cut is preferably made at an angle of 30° to the longitudinal axis of the continuous ribbon, to produce discrete strips having a parallelogram shape with 30° acute angles. The distance between the cuts is such as to produce strips each having a tip-to-tip length of about 38.1 mm. The width of the discrete strips, taken normal to the longest side of the discrete strip, is the same as the width of the continuous ribbon, i.e. 6 mm.

The cut elements are then arranged for convenient handling and placed in a furnace that is initially at room temperature (step 24).

Figure 3:
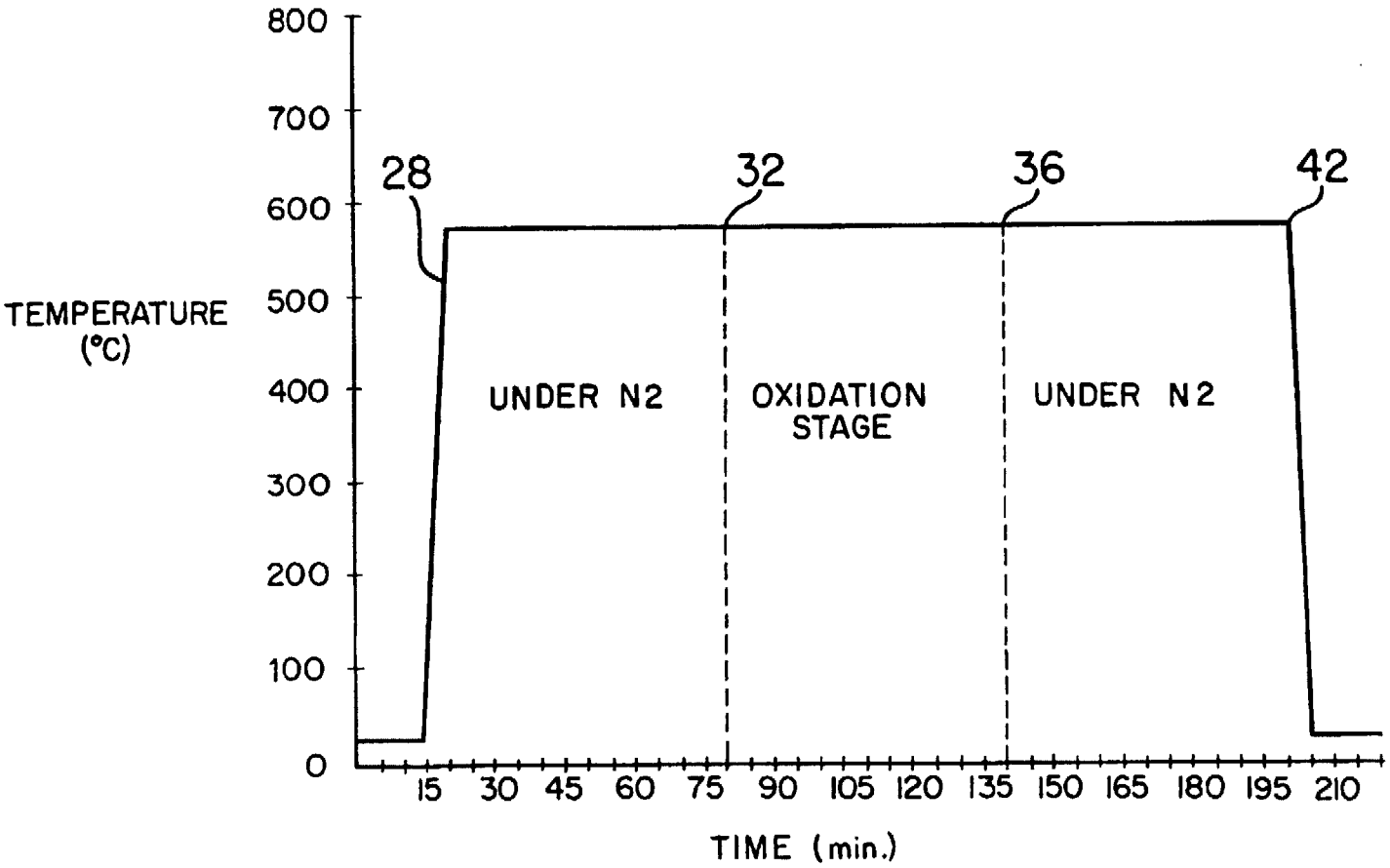
FIG. 3 is a graph which illustrates heat treating steps that are part of the process of FIG. 2.

Before applying heat to the elements in the furnace, oxygen is expelled from the furnace (step 26). For example, an inert atmosphere such as substantially pure nitrogen gas is introduced into the furnace using a pressure tank, pressure pump, or the like. Then, as indicated at 28 in FIG. 3, heating is applied to the elements, in the presence of the inert atmosphere, until the temperature of the elements is raised to about 585° C., which is above the crystallization temperature for the material. The heating indicated at 28 in FIG. 3 is shown as taking only a few minutes, which might be the case if a small number of samples is being treated. However, for a production run of samples having a total weight of about 5 of 6 pounds, increasing the temperature of all the samples from room temperature to 585° is likely to require approximately one hour or more.

After the temperature of all of the samples has been raised to 585°, that temperature and the inert atmosphere are maintained for one hour (step 30), and then the valve for the nitrogen tank is closed (point 32 in FIG. 3, step 34 in FIG. 2), so that the ambient air surrounding the furnace is allowed to enter, thereby exposing the heated elements to oxygen. The exposure to oxygen with the temperature maintained at 585° continues for one hour, and then the nitrogen tank valve is reopened to expel all oxygen from the furnace (point 36 in FIG. 3, step 38 in FIG. 2), to restore the inert atmosphere. The heat treatment continues at 585° for another hour, in the restored inert atmosphere (step 40). Then, starting at a point 42 indicated in FIG. 3, the furnace and the materials inside are allowed to cool to room temperature (step 44), while continuing to maintain the inert atmosphere.

The resulting magnetic elements are suitable for use as the semi-hard magnetic element 3 shown in FIG. 1.

Figure 4:
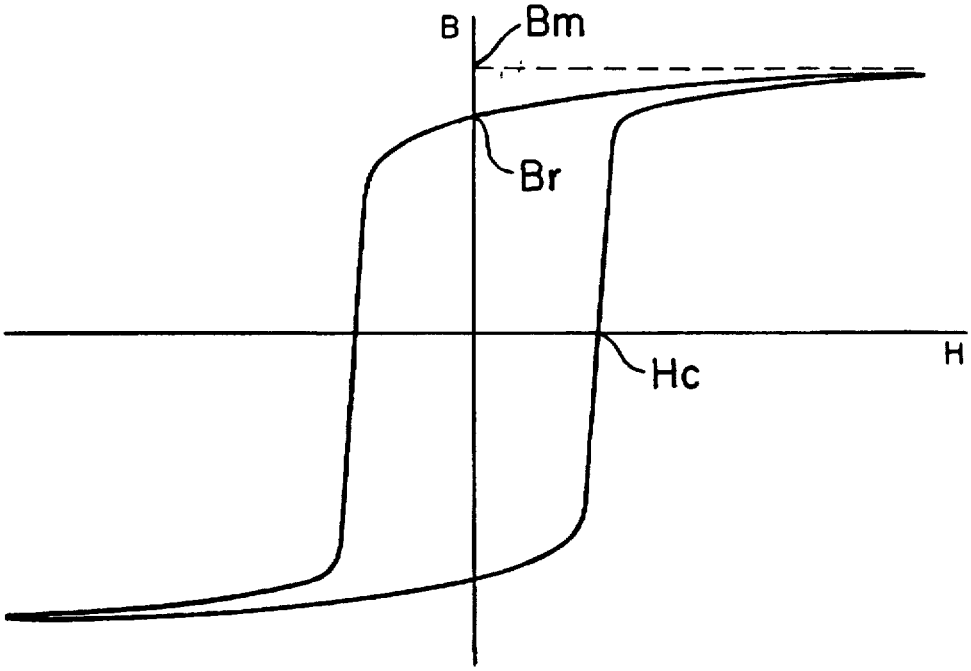
FIG. 4 shows the hysteresis characteristic of a sample of Metglas® 2505SB1 after processing in accordance with the invention.

The hysteresis loop for an element produced by this process is shown in FIG. 4, without correction for the demagnetizing effect. A coercivity Hc of 65.6 Oe was measured. The measured magnetization Bm at the point where the hysteresis loop closes was 13.06 kG, and a remanent magnetization Br of 11.05 kG was produced.

Figure 5:
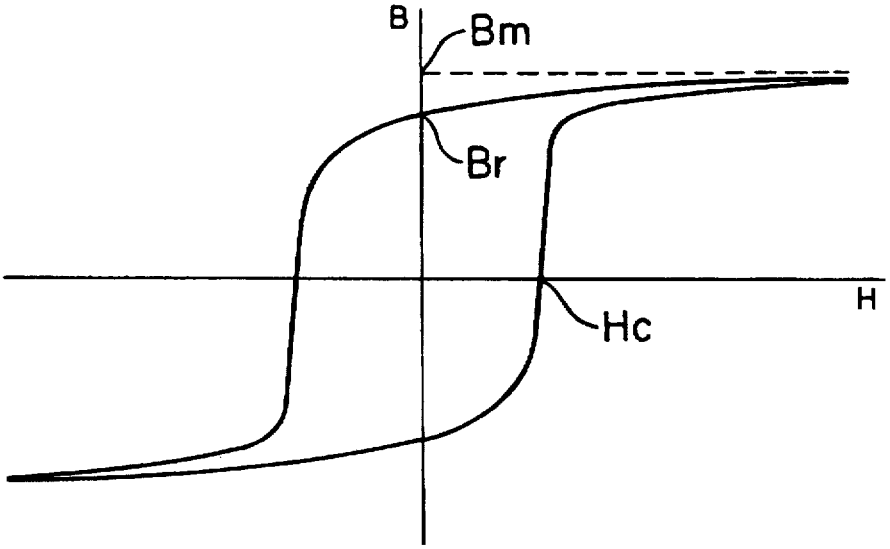
FIG. 5 shows the hysteresis characteristic of the same material, processed without the controlled oxidation step taught by the present invention.

By contrast, if the oxidation stage shown in FIG. 3 is omitted, in favor of another hour of treatment at 585° C. in the inert atmosphere, the resulting materials have a hysteresis loop as shown in FIG. 5. For the non-oxidized materials, the measured values were Hc=72.9 Oe, Bm=12.2 kG, and Br=9.78 kG. It will be noted that the controlled oxidation stage of the process illustrated in FIG. 3 results in a somewhat "taller" and "narrower" hysteresis loop characteristic (comparing FIG. 4 to FIG. 5) and a substantially increased remanent magnetic flux level.

It is believed that the process illustrated in FIG. 3 can be modified in a number of ways while still achieving the desired increase in remanent flux by controlled oxidation of the magnetic elements. For example, the sequence of one hour in nitrogen, one hour in air, followed by one hour in nitrogen, all at 585° C., can be changed to provide one hour of oxidation followed by two hours of treatment in nitrogen, provided that the oxygen-exposure stage is to begin only after the increase to 585° has been accomplished in the pure nitrogen atmosphere. Similarly, two hours of treatment in nitrogen can be followed by the one hour oxidation stage, provided that the nitrogen atmosphere is restored after the oxidation stage and before cooling. It is noted that either heating from room temperature to 585° or cooling from 585° to room temperature in an oxygen or partial oxygen atmosphere would result in uncontrolled oxidation that would likely fail to produce the desired increase in remanent flux.

According to another variation in the above procedure, a final annealing stage in the inert atmosphere, at a higher temperature, could be added immediately prior to point 42 in FIG. 3, in order to produce a material having a lower coercivity than the coercivity of 65.6 Oe obtained in the above Example. For instance, an additional one hour of annealing at about 710° C. is contemplated to produce a coercivity of about 19 Oe. Alternatively, the additional one hour of annealing may be performed at about 800° C. to produce a coercivity of about 11 Oe.

The one-hour oxidation stage can also be shortened, by providing an atmosphere during the oxidation stage that promotes faster oxidation. For example, a pure $O_2$ atmosphere, or at least an atmosphere that is richer in oxygen than air, could be provided. In addition, or alternatively, the moisture level could be increased. In these cases, a modest amount of experimentation would be required to determine an optimum duration for the oxidation stage needed to produce the desired increase in remanent flux in the processed semi-hard elements.

It is also contemplated to perform the heat treatment at a temperature that is lower or higher than the temperature value used in the above example, provided that the temperature is above the crystallization temperature for the material, which is about 545° C. for 2605SB1. With a different temperature level, the duration of the oxidation stage may need to be adjusted.

It is also contemplated to apply the above-described process to materials other than 2605SB1. For example, it is believed that controlled oxidation of the 2605TCA and 2605S2 materials discussed in the '033 patent would also produce an increase in the remanent flux. A modest amount of experimentation would be needed to determine an optimum temperature and an optimum duration for the oxidation stage.

Application of the principles of the present invention to other amorphous materials, including those which have constituents in addition to iron, silicon and boron, is also contemplated. Furthermore, it is believed that controlled oxidation of non-amorphous magnetic elements would also tend to produce an increase in remanent flux level.

Still further, it is contemplated to apply, in combination with the principles of the present invention, the principles of another invention made by the applicant of the present application. The other invention is disclosed in a co-pending patent application Ser. No. 08/673,927 filed Jul. 1, 1996, and entitled "Annealing Magnetic Elements for Stable Mechanical Properties".

According to the principles of the other invention, pre-annealing in an inert atmosphere and at a temperature of about 485° C. is carried out for about one hour or longer, prior to the treatment at 585°, to prevent mechanical deformation or "rippling" that might otherwise occur during treatment at temperatures above the crystallization temperature.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention. Thus, for example, instead of using nitrogen as the inert atmosphere, argon gas might also be used.

What is claimed is:

1. A method of making a magnetic element comprising the steps of:

providing a magnetic element formed of a magnetically soft metallic material;

heating said material to a temperature that is above a crystallization temperature for the material, said heating being performed in a substantially inert atmosphere;

exposing the heated material to oxygen while maintaining the material at a temperature above said crystallization temperature;

ending said exposing step by restoring the substantially inert atmosphere; and cooling the material to room temperature in the restored inert atmosphere.

2. A method according to claim 1, further comprising the step of annealing the metallic material in a substantially inert atmosphere for at least one hour at a temperature above said crystallization temperature.

3. A method according to claim 2, wherein said annealing step is performed before said exposing step.

4. A method according to claim 2, wherein said annealing step is performed after said restoring step.

5. A method according to claim 4, further comprising the step of first-annealing the material in a substantially inert atmosphere for at least one hour at a temperature above said crystallization temperature and before said exposing step.

6. A method according to claim 1, wherein said exposing step includes exposing said material to air.

7. A method according to claim 1, wherein said material is an amorphous metalloid.

8. A method according to claim 7, wherein said material consists substantially exclusively of iron, silicon and boron.

9. A method according to step 1, wherein the inert atmosphere consists essentially of nitrogen.

10. A magnetic element comprising an amorphous magnetically soft iron-metalloid material at least a part of the bulk of which has been crystallized to give the overall magnetic element semi-hard magnetic properties, said amorphous magnetically soft iron-metalloid material having been heated to a temperature that is above a crystallization temperature for the material while in a substantially inert atmosphere, then exposed to oxygen while being maintained at said temperature above said crystallization temperature, and then cooled to room temperature in the absence of oxygen.

11. A magnetic element according to claim 10, consisting substantially exclusively of iron, silicon and boron.

12. A marker for use in an EAS system, comprising:

a signal generating first magnetic element having an activated state in which the signal generating first magnetic element is able to interact with an applied magnetic field and a deactivated state in which the signal generating first magnetic element is disabled from interacting with said applied magnetic field; and a second magnetic element disposed adjacent said signal generating first magnetic element for placing said signal generating first magnetic element in said activated and deactivated states, said second magnetic element comprising an amorphous magnetically soft iron-metalloid material at least a part of the bulk of which has been crystallized to give the overall second magnetic element semi-hard magnetic properties, said amorphous magnetically soft iron-metalloid material having been heated to a temperature that is above a crystallization temperature for the material while in a substantially inert atmosphere, then exposed to oxygen while being maintained at said temperature above said crystallization temperature, and then cooled to room temperature in the absence of oxygen.

13. A marker according to claim 12, wherein said second magnetic element consists substantially exclusively of iron, silicon and boron.

14. An electronic article surveillance system for detecting the presence of a marker in an interrogation zone, comprising:

a marker including a signal generating first magnetic element having an activated state in which the signal generating first magnetic element is able to interact with an applied magnetic field and a deactivated state in which the signal generating first magnetic element is disabled from interacting with said applied magnetic field and a second magnetic element disposed adjacent said signal generating first magnetic element for placing said signal generating first magnetic element in said activated and deactivated states, said second magnetic element comprising an amorphous magnetically soft iron-metalloid material at least a part of the bulk of which has been crystallized to give the overall second magnetic element semi-hard magnetic properties, said amorphous magnetically soft iron-metalloid material having been heated to a temperature that is above a crystallization temperature for the material while in a substantially inert atmosphere, then exposed to oxygen while being maintained at said temperature above said crystallization temperature, and then cooled to room temperature in the absence of oxygen;

means for transmitting said magnetic field into the interrogation zone; and means for receiving a signal resulting from said signal generating first magnetic element of said marker interacting with said magnetic field.

15. An electronic article surveillance system according to claim 14, wherein said second magnetic element consists substantially exclusively of iron, silicon and boron.

* * * * *